US009988201B2

(12) United States Patent
Darin et al.

(10) Patent No.: US 9,988,201 B2
(45) Date of Patent: Jun. 5, 2018

(54) MICRO-STRUCTURED SURFACE WITH IMPROVED INSULATION AND CONDENSATION RESISTANCE

(71) Applicant: HAVI Global Solutions, LLC, Downers Grove, IL (US)

(72) Inventors: Neil Edward Darin, Grayslake, IL (US); Alexander Raymond Dembrowski, Midland, MI (US); Ralph Allen Hulseman, Greenville, SC (US); Cameron McPherson, Central, SC (US)

(73) Assignee: HAVI GLOBAL SOLUTIONS, LLC, Downers Grove, IL (US)

( * ) Notice: Subject to any disclaimer, the term of this patent is extended or adjusted under 35 U.S.C. 154(b) by 0 days. days.

(21) Appl. No.: 15/424,627

(22) Filed: Feb. 3, 2017

(65) Prior Publication Data

US 2017/0224142 A1 Aug. 10, 2017

Related U.S. Application Data

(60) Provisional application No. 62/291,833, filed on Feb. 5, 2016.

(51) Int. Cl.
*A47J 39/00* (2006.01)
*B65D 81/38* (2006.01)
(Continued)

(52) U.S. Cl.
CPC ..... *B65D 81/3865* (2013.01); *A47G 19/22* (2013.01); *B65D 65/38* (2013.01); *B65D 81/38* (2013.01)

(58) Field of Classification Search
CPC ..... E21F 17/00–17/185; B65G 11/00–11/166; B65D 65/38–65/466;
(Continued)

(56) References Cited

U.S. PATENT DOCUMENTS 2,778,173 A 1/1957 Taunton et al.
4,756,422 A 7/1988 Kristen
(Continued)

FOREIGN PATENT DOCUMENTS

DE 102008048298 A1 5/2010
EP 932136 A1 7/1999
(Continued)

OTHER PUBLICATIONS 3M, 3M Griping Material, Brochure, 2011 pp. 1-8, 3M, USA.
(Continued)

*Primary Examiner* — Kareen Thomas
(74) *Attorney, Agent, or Firm* — Neal, Gerber & Eisenberg LLP

(57) ABSTRACT

This invention is a micro-featured surface with improved insulation and condensation resistance comprising: a micro-structure included with the substrate having an arrangement of a first set of micro-features and a second set of micro-features; a first micro-feature horizontal cross section taken from the group consisting of a circle, oval, polygon, and concave portion; a condensation rate less than 0.15 grams when measure by an ambient test method; and an improved hold time of 23.00% or greater as shown by hold testing wherein a micro-feature density is in a range of 5.00% to 25.00%.

21 Claims, 11 Drawing Sheets

(51) Int. Cl.
*B65D 65/38* (2006.01)
*A47G 19/22* (2006.01)

(58) Field of Classification Search
CPC ..... B65D 81/38–81/3897; A47G 19/00–19/22
USPC ..... 220/694, 729, 4.09, 494, 600–638
See application file for complete search history.

(56) References Cited

U.S. PATENT DOCUMENTS 5,044,642 A 9/1991 Vogt et al.
5,182,069 A 1/1993 Wick et al.
5,728,086 A 3/1998 Niedospial, Jr. et al.
5,738,671 A 4/1998 Niedospial, Jr. et al.
5,857,275 A 1/1999 Deal
6,331,334 B1 12/2001 Trepte et al.
6,420,622 B1 7/2002 Johnston et al.
6,431,695 B1 8/2002 Johnston et al.
6,534,166 B1 3/2003 Pip et al.
6,540,949 B2 4/2003 Pip et al.
6,741,523 B1 5/2004 Bommarito et al.
6,800,234 B2 10/2004 Ferguson et al.
6,803,090 B2 10/2004 Castiglione et al.
6,872,438 B1 3/2005 Allgeuer et al.
6,946,182 B1 * 9/2005 Allgeuer ..... B29C 43/222 264/134
6,984,278 B2 1/2006 Anderson et al.
7,137,803 B2 11/2006 Chou
7,185,453 B2 3/2007 Spear et al.
7,534,039 B2 5/2009 Wu
7,608,160 B2 10/2009 Zhou et al.
7,703,179 B2 4/2010 Ferguson et al.
8,153,226 B2 4/2012 Curro et al.
8,318,284 B2 11/2012 Curro et al.
8,440,286 B2 5/2013 Curro et al.
8,448,530 B2 5/2013 Leuenberger et al.
8,460,568 B2 6/2013 David et al.
8,486,319 B2 7/2013 Victor et al.
8,590,193 B2 11/2013 Licha
8,720,047 B2 5/2014 Hulseman et al.
8,784,713 B2 7/2014 Victor et al.
8,814,954 B2 8/2014 Hulseman et al.
8,900,651 B2 12/2014 McClain et al.
8,926,782 B2 1/2015 Zhou et al.
9,119,450 B2 9/2015 Lee et al.
9,120,670 B2 9/2015 Hulseman et al.
9,238,309 B2 1/2016 King et al.
9,303,322 B2 4/2016 Victor et al.
9,517,122 B2 12/2016 Firstenberg et al.
9,526,640 B2 12/2016 Bertolino et al.
9,857,000 B2 * 1/2018 Agarwal ..... F16L 11/00
2001/0007682 A1 7/2001 Chiu et al.
2002/0114920 A1 8/2002 Scholz et al.
2003/0006535 A1 1/2003 Hennessey et al.
2004/0050948 A1 3/2004 Bartels
2005/0189314 A1 9/2005 Carbone
2006/0005362 A1 1/2006 Arzt et al.
2006/0121248 A1 6/2006 Lorenz et al.
2006/0214380 A1 9/2006 Dietle et al.
2007/0025648 A1 2/2007 Micnerski et al.
2007/0241515 A1 10/2007 Sato et al.
2008/0199110 A1 8/2008 Anderson et al.
2009/0065141 A1 3/2009 Kerber
2009/0082856 A1 3/2009 Flanagan
2009/0121383 A1 5/2009 Jagota et al.
2009/0146336 A1 6/2009 Masi
2009/0184175 A1 7/2009 Blankenstein et al.
2009/0233041 A1 9/2009 Rasmussen
2010/0096408 A1 4/2010 Schiewe et al.
2010/0129608 A1 5/2010 Low et al.
2010/0308497 A1 12/2010 David
2010/0320111 A1 12/2010 Maier
2011/0266724 A1 11/2011 Hulseman et al.
2011/0282284 A1 11/2011 Kriesel et al.
2011/0311764 A1 12/2011 Hulseman et al.
2012/0009387 A1 1/2012 Wang et al.
2012/0052241 A1 3/2012 King et al.
2012/0126458 A1 5/2012 King et al.
2012/0136304 A1 5/2012 Wyss et al.
2013/0101791 A1 4/2013 Hitschmann et al.
2013/0216712 A1 8/2013 Merz
2014/0147629 A1 5/2014 Tanaka et al.
2014/0200679 A1 * 7/2014 Bluecher ..... A61L 27/34 623/23.74
2014/0270599 A1 9/2014 Farhat et al.
2014/0276494 A1 9/2014 Cisko et al.
2014/0318657 A1 10/2014 Bixler et al.
2014/0343687 A1 11/2014 Jennissen
2015/0122846 A1 5/2015 Stanley et al.
2015/0140309 A1 5/2015 Pricone
2015/0175329 A1 6/2015 Wilke et al.
2015/0209846 A1 7/2015 Aizanberg et al.
2015/0298378 A1 10/2015 Hulseman et al.
2015/0298379 A1 10/2015 Hulseman et al.
2015/0307773 A1 10/2015 Hulseman et al.
2015/0327645 A1 11/2015 Lee et al.
2015/0328815 A1 11/2015 Hulseman et al.
2015/0368838 A1 12/2015 Hulseman et al.
2016/0052177 A1 2/2016 Chauvin et al.
2017/0014111 A1 * 1/2017 Hulseman ..... A61B 17/00
2017/0095019 A1 4/2017 Milbocker et al.

FOREIGN PATENT DOCUMENTS

WO 2014152477 A1 9/2014
WO 2014154659 A1 10/2014
WO 2015057053 A1 4/2015
WO 2015069857 A1 5/2015

OTHER PUBLICATIONS

Gravish et al., Frictional and Elastic Energy in Gecko Adhesive Detachment, Journal of the Royal Society Interface, 2007, pp. 1-10, FirstCite e-publishing.
Barquins, Sliding Friction of Rubber and Schallamach Waves—A Review, Materials Science and Engineering, 1985, 45-63, vol. 73.
Bico et al. Rough Wetting, IOP Science, Journal article, Jul. 15, 2001, pp. 214-220, vol. 55, Europhysics Letters.
Autumn et al., Evidence for Van Der Waals Adhesion in Gecko Setae, PNAS, Sep. 17, 2002, 12252-12256, vol. 99, USA.
Metin Sitti et al., Syntehtic Gecko Foot-Hair Micro/Nano-Structures as Dry Adhesives, J. Adhesion Sci. Technol., vol. 17, No. 8, pp. 1055-1073 (2003).
Majidi et al., Attachment of Fiber Array Adhesive Through Side Contact, Journal of Applied Physics, 2005, pp. 103521-103521-5, vol. 98, California.
Majidi et al., High Friction from a Stiff Polymer Using Microfiber Arrays, Physical Review Letters Aug. 18, 2006, pp. 076103-076103-4 vol. 97, USA.
Kustandi et al., Fabrication of a Gecko-like Hierarchical Fibril Array Using a Bonded Porous Alumina Template, Journal of Micromechanics and Microengineering, Sep. 5, 2007, pp. N75-N81, vol. 1 IOP Publishing.
Lee et al., Directional Adhesion of Gecko-Inspired Angled Microfiber Arrays, Applied Physics Letters, Nov. 13, 2008, pp. 191910-1-191910-3, vol. 93, American Institute of Physics, USA.
Autumn, Gecko Adhesion: Structure, Function, and Applications, MRS Bulletin, Jun. 2007, pp. 473-478, vol. 32.
Murphy et al., Gecko-Inspired Directional and Controllable Adhesion, Small, 2009, pp. 170-175, No. 5, Wiley-VCH Verlag GmbH & Co. KGaA, Weinheim.
Autumn et al., Gecko Adhesion: Evolutionary Nanotechnology, Phil. Trans. R. Soc. A, Jan. 11, 2008, pp. 1575-1590, vol. The Royal Society.
Mahdavi et al., A Biodegradable and Biocompatible Gecko-Inspired Tissue Adhesive, PNAS, Feb. 19, 2008, pp. 2307-2312, vol. 105 No. 7.
Forsberg et al., Contact Line Pinning on Microstructured Surfaces for Liquids in the Wnezel State, Langmuir Article, 2010, pp. 860-865, 26(2), American Chemical Society.

(56) References Cited

OTHER PUBLICATIONS

Ben-David et al., The Dynamics of the Onset of Frictional Slip, Science Mag., Oct. 8, 2010, pp. 1-7, vol. 330, AAAS.
Ben-David et al., The Dynamics of the Onset of Frictional Slip, Science Mag., Oct. 8, 2010, pp. 210-214, vol. 330, AAAS.
Zappwei et al., Looking at How Things Slip, Science Mag., Oct. 8, 2010, pp. 184-185, vol. 330, AAAS.
Y.M Park et al., Artificial Petal Surface Based on Hierarchical Micro- and Nanostructures, Thin Solid Films, Jul. 18, 2011, pp. 362-367, vol. 520, Elsevier B.V. South Korea.
Labonte et al., Surface Contact and Design of Fibrillar 'Friction Pad' in stick insects (*Carausius morosus*): Mechanisms for large Friction Coefficients and Negligible Adhesion, J. R. Soc. Interface, Jan. 27, 2014, pp. 1-13, vol. 11.
Tsipenyuk et al., Use of Biomimetic Hexagonal Surface Texture in Friction Against Lubricated Skin, J. R. Soc. Interface, Feb. 18, 2014, pp. 1-6, vol. 11.
Tian et al., Adhesion and Friction in Gecko Toe Attachment and Detachment, PNAS, Dec. 19, 2006, pp. 19320-1932, vol. 103 No. 51.
Barquins, Friction and Wear of Rubber-Like Materials, 1993, pp. 1-11, Elsevier Sequoia, France.
Ebert et al., Wear-Resistant Rose Petal Effect Surfaces with Superhydrophobicity and High Droplet Adhesion Using Hydrophobic and Hydrophilic Nanoparticles, Journal of Colloid and Interface Science, Jul. 4, 2012, pp. 182-188, USA.
Chen et al., Bio-Mimetic Mechanisms of Natural Hierarchical Materials: A Review, Journal of the Mechanical Behavior of Biomedical Materials, Nov. 17, 2012, pp. 3-33, vol. 19, Elsevier Ltd.
Liu et al., Bio-Inspired Superoleophobic and Smart Materials: Design, Fabrication, and Application, Progress in Materials Science, Nov. 15, 2012, pp. 503-564, vol. 58, Elsevier Ltd.
Lee et al., Directional Adhesion of Gecko-Inspired Angled Microfiber Arrays. Applied Physics letters, Nov. 13, 2008, pp. 191910-1-191910-3, vol. 93, American Institute of Physics.
Schubert et al., Towards Friction and Adhesion From High Modulus Microfiber Arrays, J. Adhesion Sci. Technol., Aug. 8, 2007, pp. 1297-1315, vol. 21 No. 12-13. VSP.
Cannon et al., Extrusion of Low Friction and Low Tack Microstructured Surfaces on Silicone Rubber, Oct. 9-11, 2012, pp. 1-10.
Autumn et al., Effective Elasstic Modulus of Isolated Gecko Setal Arrays, The Journal of Experimental Biology, Jun. 5, 2006 pp. 3558-3568, vol. 209, The Company of Biologists.
Autumn et al., Frictional Adhesion: A New Angle on Gecko Attachment, The Journal of Experimental Biology, Aug. 11, 2006, pp. 3569-3579, vol. 209, The Company of Biologists.
Zhao et al., Adhesion and Friction Force Coupling of Gecko Setal Arrays: Implications for Structured Adhesive Surfaces, Langmuir, 2008, pp. 1517-1524, vol. 24, The American Chemical Society.
Liu et al., Bio-Inspired Design of Multiscale Structures for Funtion Integration, Nano Today, Mar. 5, 2011, pp. 155-175, vol. 6, Elsevier Ltd.
Autumn et al., Adhesive Force of a Single Gecko Foot-hair, Nature, Jun. 8, 2000, pp. 681-685, vol. 405, Macmillan Magazines Ltd.
Machalek, Porcupine Quills, Gecko Feet and Spider Webs Inspire Medical Materials, National Institute of General Medical Sciences, Mar. 6, 2013, pp. 1-2.
Schallamach, How Does Rubber Slide?, Wear, Dec. 12, 1970, pp. 301-312, vol. 17, Elsevier Sequoia.
Qu et al., Carbon Nanotube Arryas with Strong Shear Binding-On and Easy Normal Lifting-Off, Science Mag., Oct. 10, 2008, pp. 238-242, vol. 322, AAAS.
Liu et al., A New Generation High-Drag Proppant: Prototype Development, Laboratory Testing, and Hydraulic Fracturing Modeling, SPE International, Feb. 2015, pp. 1-5, Society of Petroleum Engineers.
Pugno, Spiderman Gloves, Nano Today, Oct. 2008, pp. 35-41, vol. 3, Elsevier Ltd.
Ramesh et al., Friction Characteristics of Microtextured Surfaces Under Mixed and Hydrodynamic Lubrication, Tribology International, Aug. 7, 2012, pp. 170-176, vol. 57, Elsevier Ltd.
Villacorta et al., Viscoelastic Computational Modeling of Extruded Micro-Textured Polymeric Films, Procedia Materials Science, 2014, pp. 1460-1465, vol. 5, Elsevier Ltd.
U.S. Appl. No. 62/291,833.
U.S. Appl. No. 62/319,563.
U.S. Appl. No. 62/355,081.
U.S. Appl. No. 62/372,896.
International Search Report & Written Opinion Dated Apr. 13, 2017 for PCT Application No. PCT/US2017/016579 (8 pages).
International Search Report & Written Opinion Dated Aug. 7, 2017 for PCT Application No. PCT/US17/26435 (12 pages).
International Search Report & Written Opinion Dated Aug. 28, 2017 for PCT Application No. PCT/US2017/0390085 (11 pages).

* cited by examiner

MICRO-STRUCTURED SURFACE WITH IMPROVED INSULATION AND CONDENSATION RESISTANCE

CLAIM OF PRIORITY

This application claims priority from U.S. Provisional Application 62/291,833 filed Feb. 5, 2016.

BACKGROUND OF THE INVENTION

1) Field of the Invention

The present invention relates to a surface such as a beverage cup, bottles, paper labels, appliance surfaces, bowls, containers, pipe, and the like, having improved insulation properties, reduced condensation and improved tactile feel.

2) Description of Related Art

For beverage container such as coffee cups and the like, the beverage is typically served at temperatures in excess of 160° F. and even in excess of 185° F. Even brief exposure to these temperatures can cause significant scalding. The risk of scalding is increased with hot beverages when served in paper or plastic disposable cups. The paper or plastic must be kept thin to reduce cost, weight, and the height or volume of a stack of cups.

Attempts have been made to balance the thinning of the paper or plastic of the cup materials with the need to protect from scalding such as U.S. Pat. No. 5,222,656 directed to a sleeve for insulating the hand while holding a beverage cup. A tubular body of felt-like material conforms by a press fit relationship with the sidewall of a beverage cup when the beverage cup is inserted into the sleeve through the first end of the body. U.S. Pat. No. 5,579,949 is directed to a "C" shaped sleeve for insulating the hand while holding a beverage cup. A plastic molded shape having two broadened ends connected by a thinner central strip form a "C" that is sized to be slightly under the diameter of a conventional hot beverage cup and to snap onto the sidewall of the beverage cup and hold in a spring like fashion. U.S. Pat. No. 5,667,135 is directed to "honeycombed" insulation sleeve disposed around a beverage cup. U.S. Pat. No. 5,454,484 is directed to paper sleeve, stored in folded configuration, and expanded for receiving a cup.

There is also disadvantages of placing cold liquids in "thin" containers in that temperature differences between the beverage container outer wall, ambient temperature, and moisture levels can cause condensation on the outer wall of the beverage container. Such containers include paper or plastic cups, ice cream containers, and ice trays just to name a few. Previous attempts to reduce or eliminate the effect of condensation on such a surface have been tried. Condensation on the surface, such as a beverage container, bowl and the like, can damage supporting surfaces such as table tops an counter tops. Additionally, condensation on a surface can reduce the ability to securely hold the surface such as with a beverage container becoming "slick". Additionally, condensation on the surface can cause the underlying structure to degrade. The well-known effect of condensation on paper cups where the condensation breaks down the structural integrity of the beverage container is one example.

Such attempts to manage condensation include U.S. Pat. No. 1,910,139 directed to a liquid absorbing pad placed on supporting surfaces such as under glasses, pitchers and other receptacles whereby the condensation which forms and accumulates on the outside of the receptacles when used for serving cold beverages may be absorbed and prevented from wetting the supporting surfaces. Other coasters are described in U.S. Pat. Nos. 2,014,268; 1,959,134, 2,215,633, and 2,595,961. Much effort has been directed to the management of condensation and not necessarily to the prevention of condensation on these paper or plastic beverage cup, especially those with thinner walls and especially for disposable beverage containers.

Additionally, for beverage containers used with cold liquids, condensation can be reduced by using insulating rubber or foam sleeves. However, these solutions are expensive and add additional weight. Much attention should be spent on reducing heat transfer, scalding, and condensation on thin, disposable paper or plastic cups.

By way to example and not limitation, the beverage container will be used in the application to illustrate the invention. The invention can apply as well to a surface that is used for ice trays, bottles, paper or plastic cups, ice cream containers, ice containers, coolers, pipe, mechanical parts, electrical parts, durable goods, and other such articles that can use the benefits of the present invention to improve the insulation against heat and prevent condensation that occurs due to the temperature differential in proximity to the surface.

Accordingly, it is an object of the present invention to provide a beverage container that provides improved insulation properties for hot liquids and reduces condensation for cold liquids.

It is another object of the present invention to provide a beverage container that reduces or eliminates the need for cup sleeves and coasters, or that allow the sleeve to be thinner and lighter weight.

It is another object of the present invention to provide improved insulating ability of thin surfaces to control heat transfer from the surface to an object touching the surface or to improve resistance to condensation of liquids from a humid atmosphere.

It is another object of the present invention to reduce the sensation of heat and to protect the hand from scalding without the need for an insulating glove, a second cup used over the inner cup, a paper sleeve or corrugated paper for a cardboard second layer or sleeve to prevent additional cost, weight, and thickness.

SUMMARY OF THE INVENTION

The above objectives are accomplished according to the present invention by providing a micro-structure that can include micro-features or a patterned micro-surface of a particular design to control heat transfer between the cup surface and the external environment. A notable aspect of the design of the patterned micro-surface is the use of high aspect ratio features that are taller than they are wide. The micro-features provide for a decrease in condensation on the outer wall of the beverage container containing a cold liquid. The decrease in condensation includes decreased condensation or humidity on a container containing a cold liquid and that do not leave condensation on a surface below the container after 25 minutes in a humid environment.

The micro-features on a surface can reduce heat transfer between a surface made from rubber, paper, metal, plastic, glass, ceramic, or any combination thereof. The surface can be manufactured by injection molding, compression molding, lamination, embossing, stamping, sintering, additive manufacturing, milling, electrical discharge machining, casting, laser engraving, or by printing processes including ink jet processes, roll to roll contact print processes, intaglio printing, cast and cure transfer printing and similar printing processes. The micro-features can be made by printing ink on paper using inks that form three dimensional structures and include methods such as ink jet printing, thermal printing, additive manufacturing, and the like. The micro-features can be formed by the use of expandable materials which expand into a mold to form or impart features into the expandable material. The microfeatures can be applied to a material surface where multiple microfeatured surfaces can be brought together in successive steps whether of the same or multiple materials to make a combined micro surface the achieves the same performance or instances where the microfeatures can be placed on both sides of the material to achieve an additive benefit.

The micro-features themselves can be taken from the group consisting of regular or irregular horizontal cross section shape including circles, ovals, squares, triangles, polygons, or ridges.

The invention can include a surface having micro-features where the micro-features are between 70 μm and 1000 μm tall where the micro-structure density is between about 0.5% and 25% and includes the physical property of reducing heat transfer from a hot surface to a second surface that rests against the outer ends of the micro-features facing away from the hot surface. The micro-features are uniformly distributed in a random patterned array. The surface can be disposed on a beverage container. The beverage container can be held by a person from 11 seconds for a smooth cup to over 29 seconds for one with micro-structures when the beverage container includes liquid with a temperature of 190° F. or higher. Condensation or humidity on a cup containing a cold liquid and on a surface below the container can be decreased in relation to a beverage cup without the surface. The surface can include a decrease in condensation or humidity on a surface and that does not leave condensation on a surface below the container after 25 minutes in a humid environment. The surface can be made of rubber, paper, metal, plastic, glass, ceramic, or any combination. The surface can be made by injection molding, compression molding, lamination, embossing, stamping, sintering, additive manufacturing, milling, electrical discharge machining, casting, laser engraving, or by printing processes including ink jet processes, roll to roll contact print processes, intaglio printing, cast and cure transfer printing and similar printing processes. The surface can be made by ink jet printing, thermal printing, additive manufacturing, and the like, and any combination. The micro-features can include any regular or irregular horizontal cross section shape including circles, ovals, squares, triangles, polygons, linear ridges, or any combination thereof. The micro-features can be used in conjunction with other micro-features, dispersed within the same area, separated in distinct areas, or on the opposing side of the material carrying the micro-feature.

The invention can include a micro-featured surface with improved insulation and condensation resistance comprising: a micro-structure on a substrate having an arrangement of a first set of micro-features and a second set of micro-features; a first micro-feature horizontal cross section taken from the group consisting of a circle, oval, polygon, and concave portion; a first micro-feature horizontal cross section dimension included in the first set of micro-features in a range of 300 μm to 750 μm; a pitch included in the micro-structure in a range of 450 μm to 1650 μm; a spacing between the first set of micro-features in the micro-structure in the range of 300 μm to 1650 μm; a depth of the first set of micro-features in a range of 420 μm to 2000 μm; a condensation rate less than 0.15 grams when measured by an ambient test method; a second set of micro-features included in the first set of micro-features having a second micro-feature horizontal cross section taken from the group consisting of pillars and opening; a second micro-feature horizontal cross section dimension included in the set of micro-features equal to or less than 100 μm; and, an improved hold time of 23.00% or greater as shown by hold testing wherein a micro-feature density is in a range of 0.5% to 25.00%.

The second set of micro-features can include an opening defined in a top of a first micro-feature having a diameter of about 100 μm and extending into a micro-feature at least 50 μm. The surface can have pillars extending upward from a top of a first micro-feature having a width of about 50 μm and a height of about 50 μm. The pillars can include a width of a micro-feature in the first set of micro-features has a length greater than a width and are arranged offset relative to an adjacent first micro-feature in the micro-structure. The micro-features can be arranged in an alternating orthogonal pattern in the micro-structure.

The micro-features can include a micro-feature horizontal cross section dimension included in each micro-feature in the range of 300 μm to 750 μm; a pitch included in the micro-structure in the range of 450 μm to 1950 μm; a spacing between the micro-features in a range of 50 μm to 1650 μm; a depth of the micro-features in a range of 230 μm to 2000 μm; and, a condensation rate improvement greater than 25%. The micro-featured surface can include a micro-structure disposed on a substrate having a first set of micro-features included on the substrate and a second set of micro-features included in the first set of micro-features; a first micro-feature horizontal cross section taken from the group consisting of a circle, oval, polygon, and concave portion; a first micro-feature horizontal cross section having a width of about 200 μm; second micro-feature horizontal cross section taken from the group consisting of pillars and opening; a second micro-feature horizontal cross section dimension included in the set of micro-features equal to or less than 100 μm; and, an improved hold time of 23.00% or greater as shown by hold testing wherein a micro-feature density is in the range of 0.5% to 25.00%.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Figure 1:
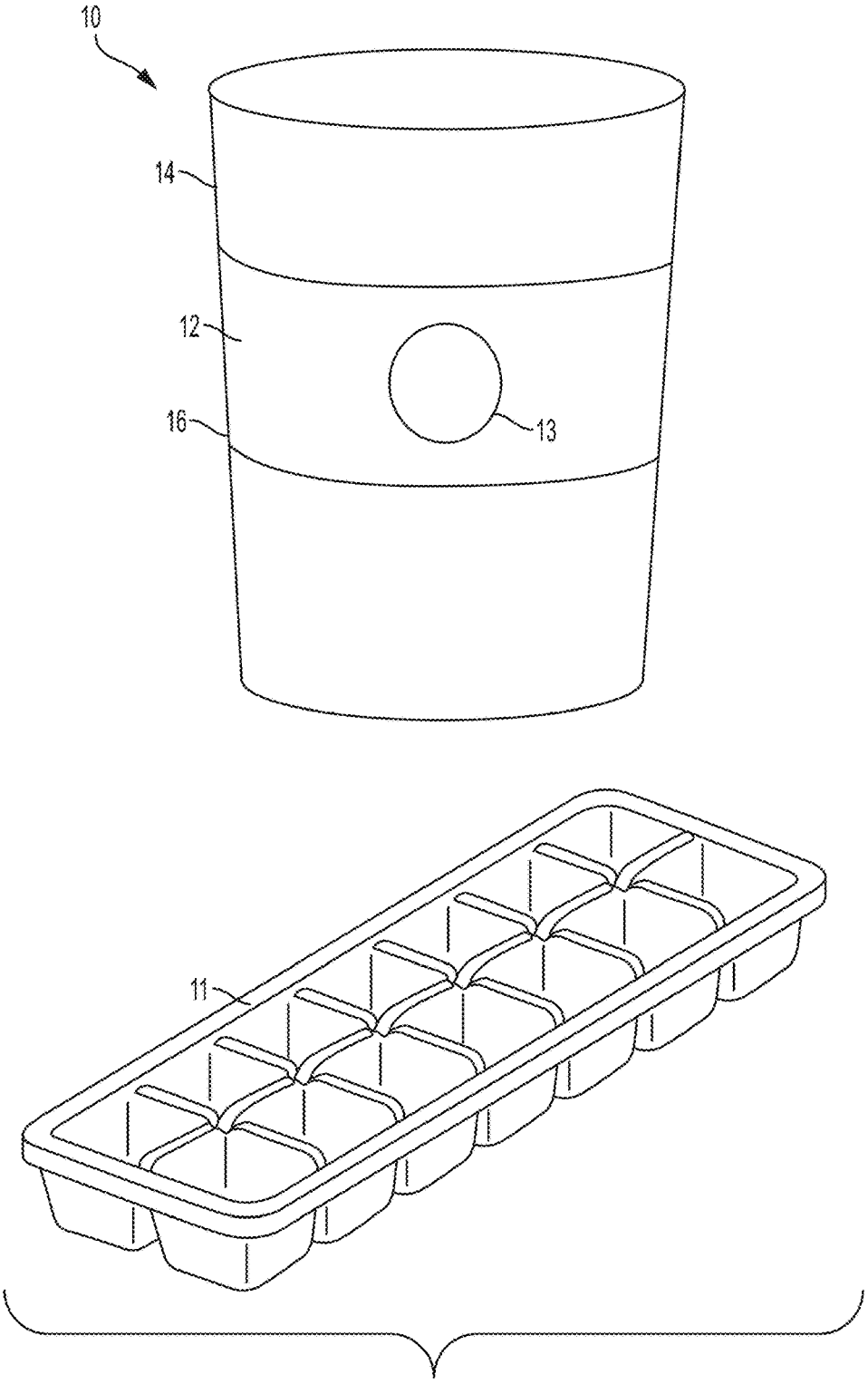
FIG. 1 shows a front view of aspects of the invention.
Figure 2A:
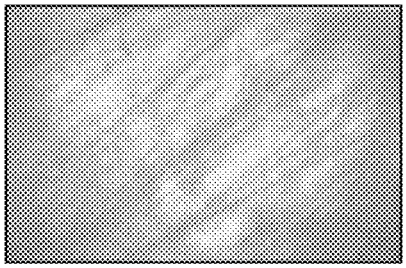
FIGS. 2A-F show several physical properties of the invention.
Figure 2B:
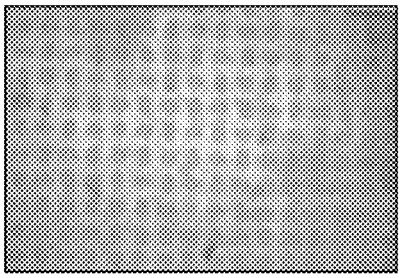
Figure 2C:
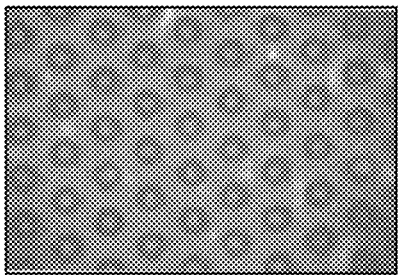
Figure 2D:
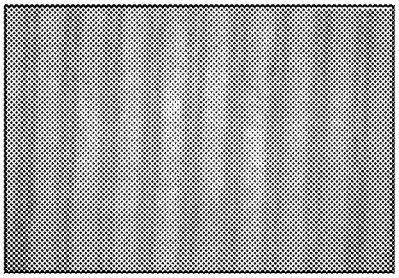
Figure 2E:
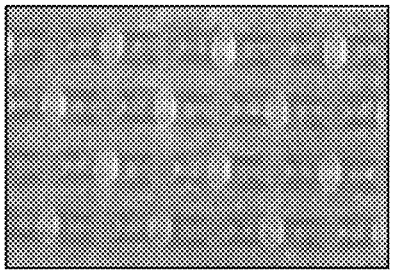
Figure 2F:
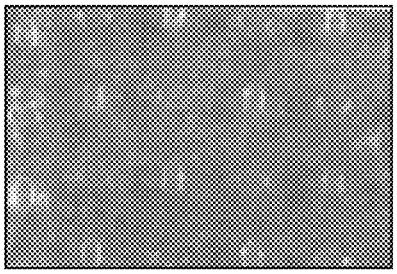

Referring to FIG. 1, a container 10, cup in one example, is provided with micro-structures 12 on at least a portion of the outer wall 14 of the container that can come into contact with an individual's hand having a micro-structured outer wall surface 16 of a beverage container. The portion having micro-features can be of any shape, and can be transparent or partially transparent so as to allow a graphic 13, such as a logo, to view through the micro-feature. The micro-structured surface can also be on a surface that is integrated into an article such a cup, glass, beverage container, film wrap, tape, label, pipe, or ice tray 11, to provide some examples. The micro-features can be manufactured into the outer wall surface. In one embodiment, the micro-features or micro-patterns can include individual features with height between 70 μm and 1000 μm. The micro-structures with a micro-feature density on the outer wall of the beverage container of between about 0.5% and 25% reduce heat transfer from a hot surface (such as an outer wall) to a second surface (such as a hand) that rests against the outer ends of the micro features facing away from the hot surface. The micro-features can be uniformly distributed in a random pattern or can be systematically arranged such as in rows, grids, asymmetrical arrangement, offset rows, or any combination.

The substrata can include a micro-structured side where the micro-feature included in the micro-structure is disposed away from an article where the micro-structure is attached. The micro-structure can be manufactured into an article, such as a cup, so that the substrate coincides with a surface of the article itself. In one embodiment, the substrate can be adhered to an article and therefore can include an attachment side to adhere the substrate to an article allowing the micro-structured side to face outward from the article.

Using the microstructure can increase the hold time a container containing a hot liquid can be held by a person, test subject, from 11 seconds for a smooth cup to over 29 seconds for a micro-structured cup in one embodiment. This is shown by hold testing, in one scenario, by having test subjects hold cups filled with water heated to at least 190° F. The cups were covered with polypropylene sheets that had various micro-surface patterns embossed on their outer surface. The time was measured until the cup was uncomfortable to hold and the person needed to set it down. Multiple repeats of the test were done to ensure that the results were valid. From these test, the following results were obtained as shown in Table 1 and FIG. 2A through 2F corresponding below.

TABLE 1

| Pattern | FIG. | Average Hold Time (Seconds) | Percent Improvement | Average Temperature (° F.) |
|---|---|---|---|---|
| Control | 2A | 11.48 | 0.00% | 175.07 |
| #003AP | 2B | 20.11 | 75.17% | 176.09 |
| #049AP | 2C | 14.07 | 22.56% | 170.5 |
| #008AP | 2D | 18.71 | 62.98% | 176.01 |
| #128AP | 2E | 29.22 | 154.53% | 175.4 |
| #129AP | 2F | 14.16 | 23.34% | 175.01 |

The micro-feature density on the outer wall is related to the improved insulation properties an anti-condensation property of the present invention. Micro-feature density is the ratio of micro-structured feature in a given area to the total area. For example, if a portion of the outer surface of the beverage container is 100 $cm^2$ and the micro-feature structures occupy 10 $cm^2$, then the micro-feature density would be 10%. The micro-feature density can be varied from 0% to 100%. Hold time (in seconds), in one scenario, relates to the micro-feature density (in percentages) as shown in Table 2.

| Micro-feature Density (approximate) | Hold Time (Approx. secs) | Hold Time Improvement |
|---|---|---|
| 0% | 11 | 0.00% |
| 5% | 14 | 27.27% |
| 10% | 20-30 | 127.27% |

-continued

| Micro-feature Density (approximate) | Hold Time (Approx. secs) | Hold Time Improvement |
|---|---|---|
| 20% | 19 | 72.73% |
| 25% | 14 | 27.27% |
| 100% | 11 | 0.00% |

From the data gathered in the hot cup portion of this study it appears that embodiment #128AP performed the best in average hold time when being observed in a general demographic or participants.

The present invention can also include several embodiments where the micro-feature height is varied and that hold time is affected by the micro-feature height. The relationship between the micro-feature height and the hold time is shown in Table 3.

TABLE 3

| Micro-feature Height (approximate μm) | Hold Time (Approx. secs) |
|---|---|
| 0 | 11 |
| 70 | 20 |
| 75 | 14 |
| 220 | 14 |
| 350 | 18 |
| 420 | 29 |

A micro-feature that that is 420 microns tall and that has 1% contact to the skin, tested the same of the paper sleeve (in the range 52 to 65 seconds). The upper 50 microns of the pillar had reduced area of contact. The two level design prevented penetration into the skin to the depth of the nerves. Thus it was comfortable when squeezed (in either cups filled with hot or cold beverage). In one embodiment includes micro-features that are 1000 micron tall and have 11% contact to the skin. This embodiment tested superior to the paper sleeve (range 30 to 199 seconds). As shown, increasing the micro-feature height improves the hold time for a beverage container with hot liquid. Table 4 illustrates additional properties of the present invention.

TABLE 4

| Pattern ID | Pattern Description | Feature Size | Feature Height | Distance Between Features | Contact % |
|---|---|---|---|---|---|
| Control | Smooth Control | NA | NA | NA | 100 |
| #003AP | Ovals | 50 μm × 25 μm | 70 μm | 100 μm | 9.8 |
| #049AP | Wide Continuous Lines | 50 μm | 75 μm | 200 μm | 25 |
| #008AP | Circles | 200 μm | 350 μm | 400 μm | 19.6 |
| #128AP | Oval | 300 μm × 600 μm | 420 μm | 1.2 mm | 9.8 |
| #129AB | Oval | 150 μm × 300 μm | 220 μm | 900 μm | 4.4 |

Further testing was conducted with additional micro patterns developed as shown in Table 5.

TABLE 5

Additional Micro Patterns Developed for Hot Surfaces

| ID | | Width | Shape | Pitch | Array | Height | Contact |
|---|---|---|---|---|---|---|---|
| H226AP | Cold study | 450 | circle | 1200 | rectangular | 1000 | 11.0% |
| H227AP | Cold study | 450 | circle | 1200 | rectangular | 2000 | 11.0% |
| H238AP | New | 300 × 600 | ellipse | 2400 | rectangular | 600 | 2.5% |
| H239AP | New | 200 × 150 | Circular pillar with indent hole | 1200 | Rectangular | 420 | 1.0% |
| H240AP | New | 200 × 200, 100 × 100 | Square pillar with indent cross | 1200 | Rectangular | 420 | 2.1% |
| H241AP | New | 150 | Circular pillar | 1200 | Rectangular | 420 | 1.2% |

Table 6 shows results of testing the additional surfaces.

TABLE 6

Test Results for Hold Time with Hot Liquids

| Paper Cups with Micro Pattern ID | Range of Tests Hold Times (approximate seconds) | Ranking Points (Pair wise comparisons) | Rank (lowest number is best) |
|---|---|---|---|
| H226AP | 50 to 199 | 10.5 | 2 |
| H227AP | 55 to 134 | 11 | 1 |
| H238AP | 13 to 39 | 4.5 | 5 |
| H239AP | 42 to 65 | 8 | 3 |
| H240AP | 21 to 45 | 6 | 4 |
| H241AP | 3 to 39 | 2 | 8 |
| Paper Cup with Polypropylene Film Coat | 4 to 32 | 3 | 7 |
| Paper Cup | 5 to 28 | 1 | 9 |
| Paper Cup with Paper Sleeve | 21 to 120 | 5 | 6 |

In pair-wise comparison ranking measuring the time for several people holding the cups and comparing in pairs, micro surfaces H226AP and H227AP were superior to with use paper sleeve or the paper or polypropylene coated cups. H238AP, H239AP, and H240AP gave statistically the same hold time as when a paper sleeve was used and were superior to the paper or polypropylene coated cups. Further reduction of contact area and increases in height improved hold time.

We also see that a reduction of condensation, measured by weight, for a beverage container with a cold liquid based upon the particular microstructure pattern that is used. Referring to FIG. 2A through 2F, the micro-feature patterns that are included in several embodiments are shown and designated pattern #000, #003AP, #008AP, #049AP, #128AP and #129AP respectively. Pattern 000 is a non-micro-featured surface and used a control for testing of the various embodiments of the present invention. Pattern #003AP generally contains micro-features with horizontal cross sections that are oval and can include rounded edges. The various micro-features can be arranged so that the long axis of the micro-features alternate about 180 degree to the adjacent micro-feature or are in an alternating orthogonal pattern. Pattern #008AP includes a horizontal cross section that is generally circular and can have generally flat or rounded tips or tops. The micro-features can be arranged in an offset linear fashion so that the vertical rows are offset in relation to the adjacent vertical rows. Pattern #049AP is ridges that run along the surface in generally parallel formation. Pattern #128AP generally contains micro-features with cross sections that are elliptical. The various micro-features can be arranged so that the long axis of the micro-features alternate about 180 degree to the adjacent micro-feature or are in an alternating orthogonal pattern.

Figure 3A:
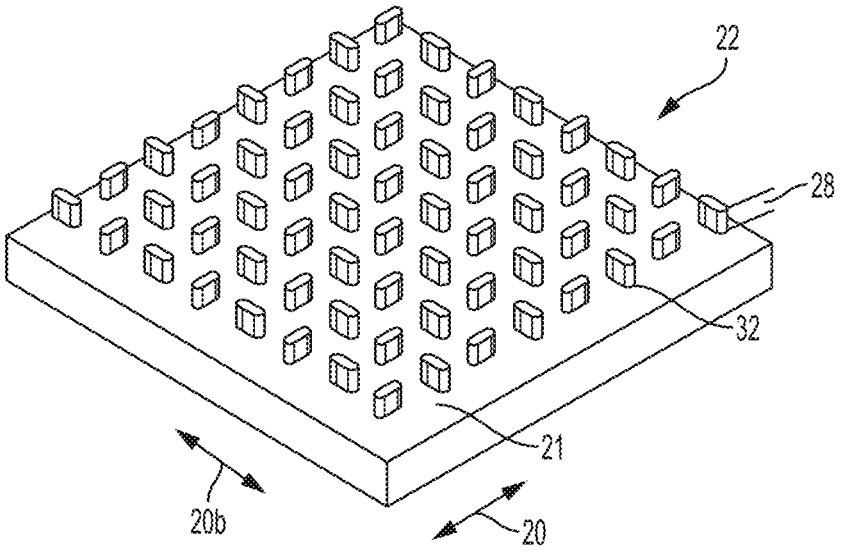
FIG. 3A is a perspective view of aspects of the invention.
Figure 3B:
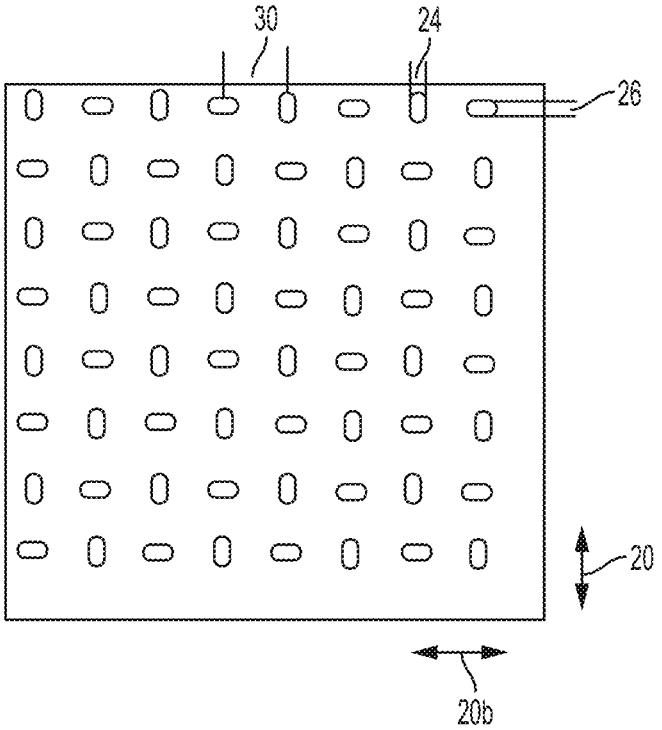
FIG. 3B is a top view of aspects of the invention.

Referring to FIGS. 3A and 3B, a perspective view and top view showing micro-features that are have a generally oval horizontal cross section 21. The micro-features can be arranged so that the long axis 20*a* of the micro-features alternate about 180 degrees to the adjacent long axis 20*b* micro-feature or are in an alternating orthogonal pattern shown generally as 22. In one embodiment, the width 24 of the micro-feature is in the range of 0.25 mm and 0.30 mm; the length 26 is in the range of 0.55 mm to 0.65 mm. The height 28 is in the range of 0.35 mm and 0.50 mm. The spacing 30 between micro-feature is in the range of 1.10 mm and 1.30 mm. In one embodiment, the ends 32 of the micro-feature can be curved.

Figure 4A:
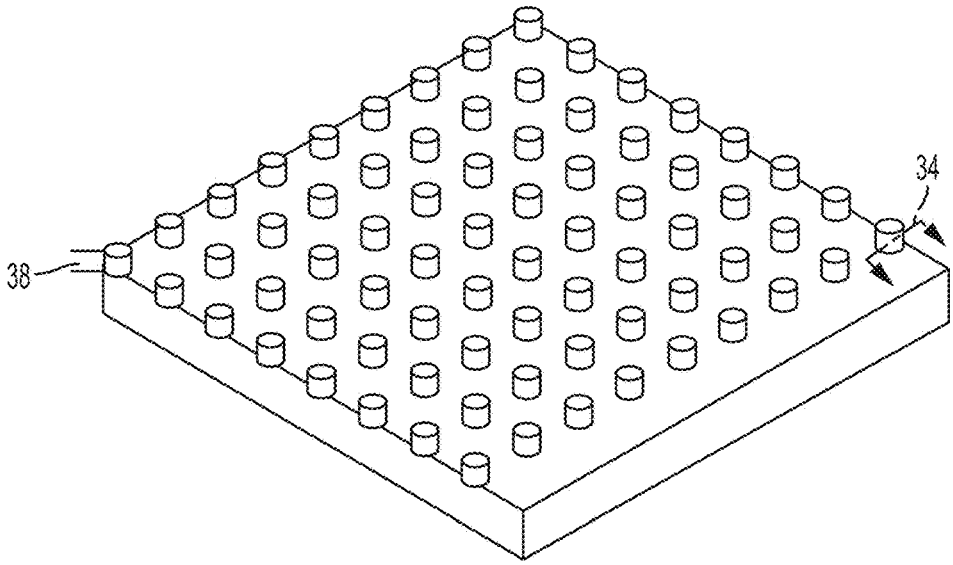
FIG. 4A is a perspective view of aspects of the invention.
Figure 4B:
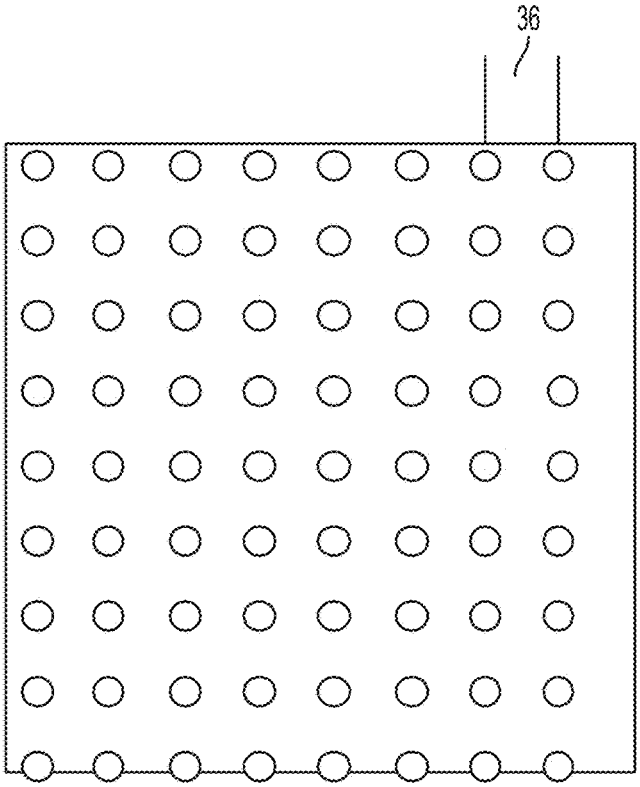
FIG. 4B is a top view of aspects of the invention.

Referring to FIGS. 4A and 4B, the micro-features shown can have a generally circular cross section 34. In one embodiment, the diameter of the cross section is in the range of 0.40 mm to 0.50 mm. The pitch, or distance 36 between micro-features is in the range of 1.10 mm and 1.30 mm. The height 38 is in the range of 0.35 mm to 0.50 mm. In one embodiment, the pitch 40 can be in the range of 0.40 mm to 0.60 mm and is about 0.50 mm in one embodiment. In one embodiment, the pitch is in the range of 0.70 mm and 0.80 mm and 0.75 mm on one embodiment. In one embodiment, the pitch is in the range of 1.80 mm and 2.10 mm and 1.95 mm in one embodiment. In one embodiment, the pitch is in the range of 3.40 mm and 3.50 mm and 3.45 mm on one embodiment. In one embodiment, the diameter of the micro-features is in the range of 0.05 mm and 0.15 mm. The pitch is in the range of 0.80 mm and 0.90 mm. The height can be in the range of 0.025 mm to 0.075 mm in one embodiment, 0.8 mm to 1.2 mm in one embodiment and 1.8 mm to 2.2 mm in one embodiment.

Figure 5A:
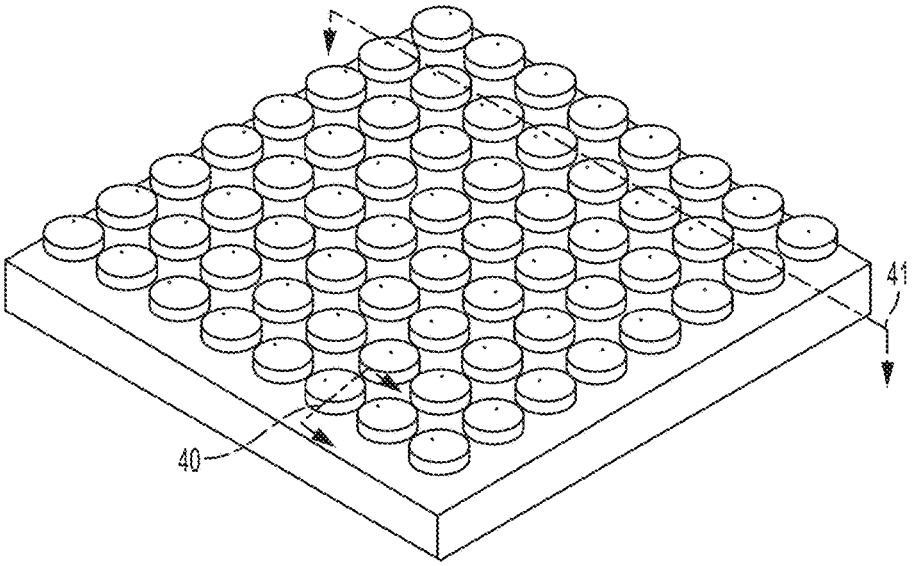
FIG. 5A is a perspective view of aspects of the invention.
Figure 5B:
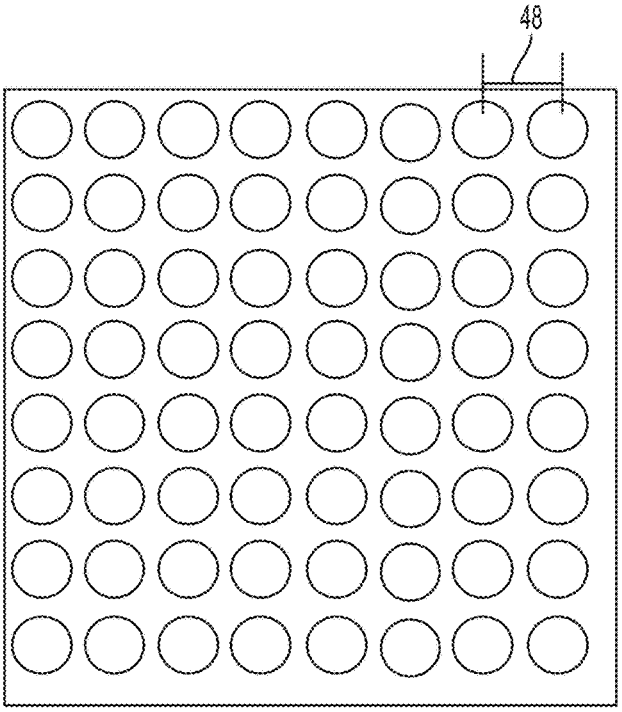
FIG. 5B is a top view of aspects of the invention.
Figure 5C:
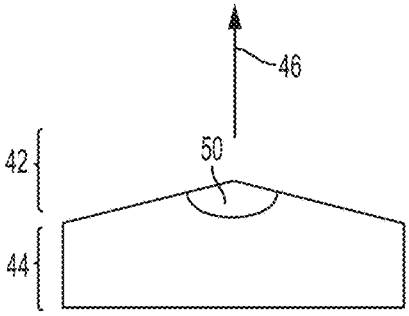
FIG. 5C is a side view cut section of aspects of the invention.
Figure 6A:
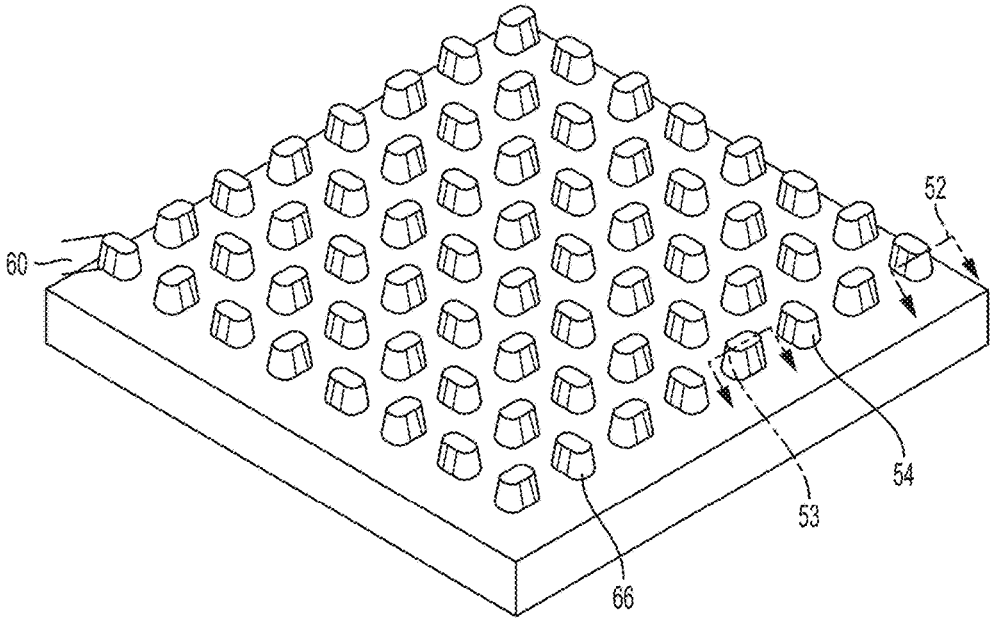
FIG. 6A is a perspective view of aspects of the invention.
Figure 6B:
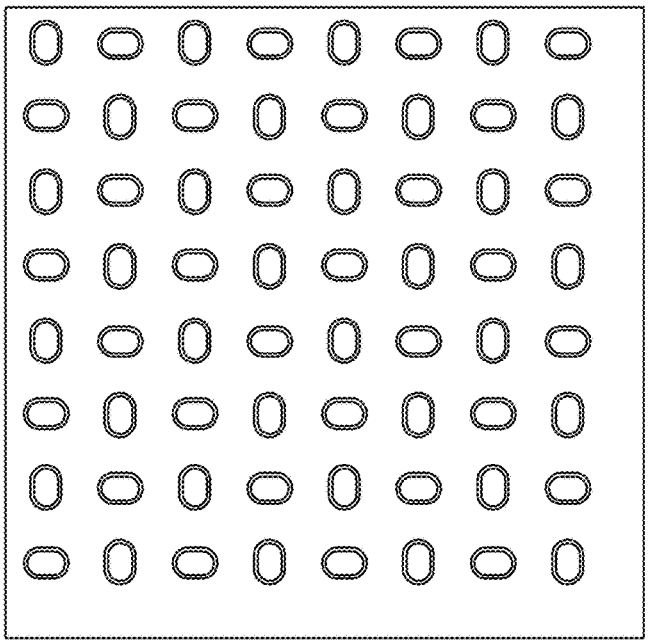
FIG. 6B is a top view of aspects of the invention.
Figure 6C:
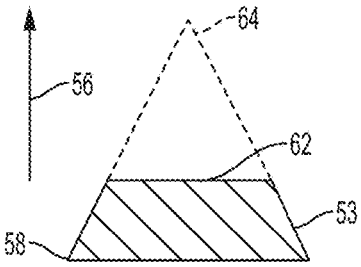
FIGS. 6C and 6D are side view cut sections of aspects of the invention.
Figure 6D:
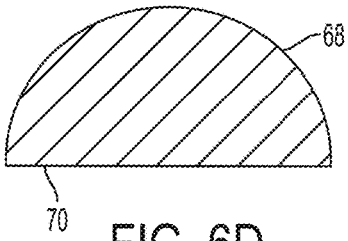

Referring to FIGS. 5A through 5C, one embodiment of micro-features is shown. In this embodiment, the micro-feature can have a generally circular horizontal cross section 40 in a lower section 44 with a conical section 42 adjacent to the lower section wherein the in the conical section the diameter of the conical section decreases in a direction 46 opposite the substrate. The lower section can have an elevated cross section of a polygon, rectangle, and square. The pitch 48 can be in the range of 1.10 mm to 1.3 mm. The diameter of the lower section can be in the range of 0.8 mm to 1.2 mm. The height of the lower section and conical section together can be in the range of 0.35 mm to 0.5 mm. Referring to FIG. 5C, showing an elevated cross section along 41, the conical section can include a top angle 50 in the range of 130° to 150°. In one embodiment, the micro-feature does not include the lower section. The pitch can be in the range of 2.50 mm to 3.00 mm. The height of the conical section can be in the range of 0.30 mm to 0.50 mm.

Referring to FIGS. 6A through 6D, the micro-features can include generally oblong horizontal cross sections 52 and can be arranged with alternating 180° offset relative to the adjacent micro-features. The sides 54 of the micro-feature can include a curve. On one embodiment, the area of the elevated cross section 53 can decrease in a direction 56 opposite the substrate. The pitch can be in the range of 1.00 mm to 1.40 mm. The elevated cross section at the largest point 58 of the micro feature can be in the range of 0.40 mm to 0.80 mm. The height 60 of the micro-feature can in the range of 0.35 mm to 0.50 mm. In one embodiment, the top 62 of the micro-feature is generally flat. The opening angle 64 can be in the range of 10° to 20°. In one embodiment, the opening angle is in the range of 20° to 50°. In one embodiment, the top 66 of the micro-feature can be rounded. In one embodiment, the micro-feature is a partial sphere having a diameter in the range of 0.40 mm to 0.50 mm. The partial sphere 68 can have a radius 70 of 0.23 mm.

Figure 7A:
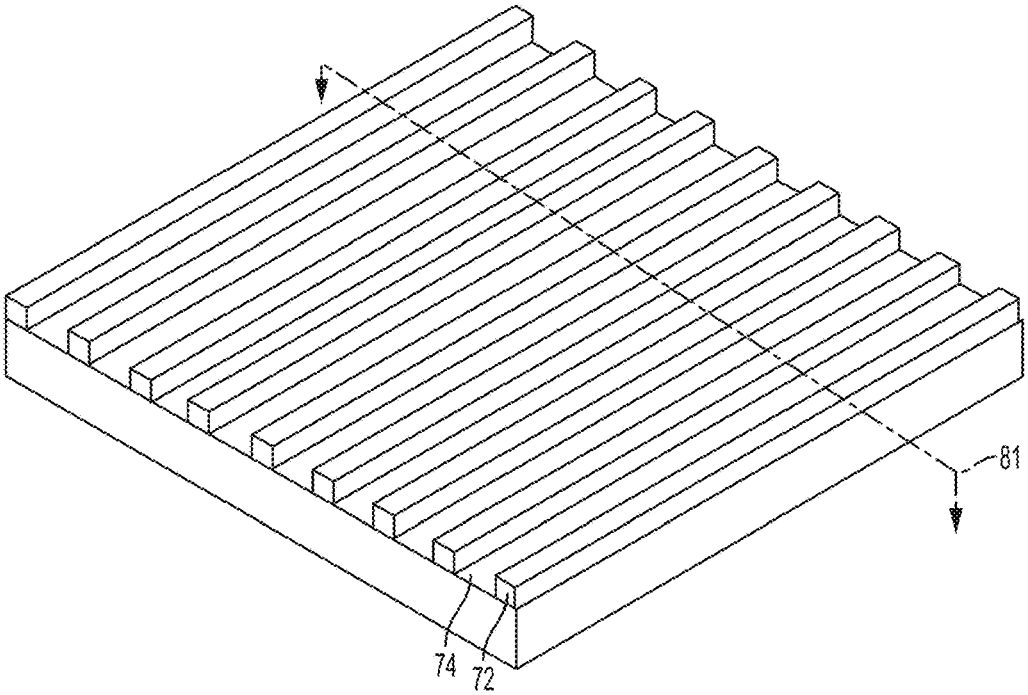
FIG. 7A is a perspective view of aspects of the invention.
Figure 7B:
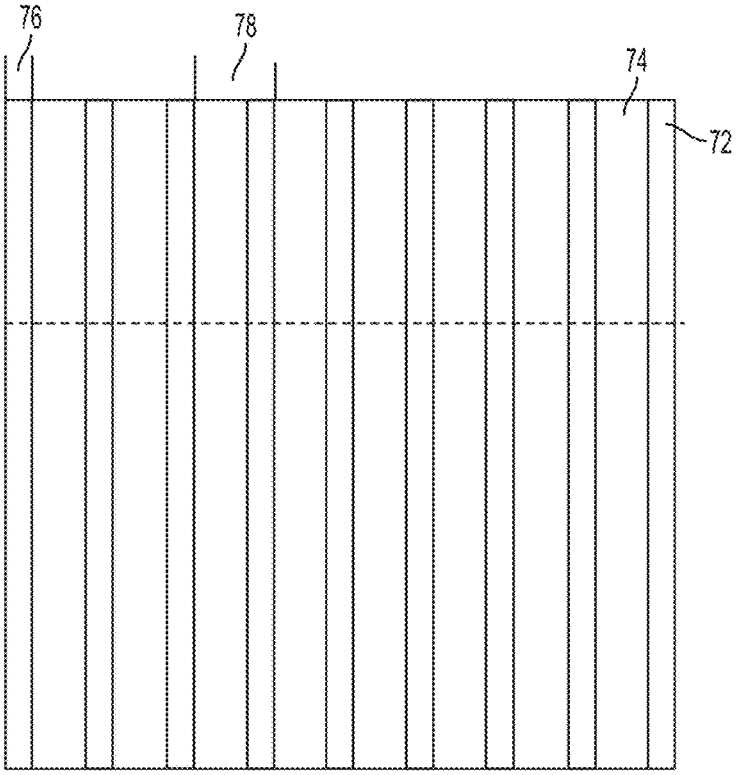
FIG. 7B is a top view of aspects of the invention.
Figure 7C:
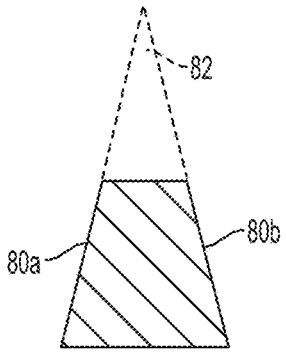
FIG. 7C is a side view cut section of aspects of the invention.

Referring to FIGS. 7A and 7B, one embodiment is shown with ridges 72 defining slots 74 on a substrate. The ridges can have a width 76 in the range of 0.30 mm to 0.50 mm, a pitch 78 in the range of 1.00 mm to 1.40 mm and a height 80 in the range of 0.30 mm to 0.50 mm. The ridges can be tapered side 80*a* and 80*b* with an open angle 82 in the range of 2.00° to 5.00°. An elevated cross section of one or more micro-features along direction 81 can be a polygon and in one embodiment, a square.

Figure 8A:
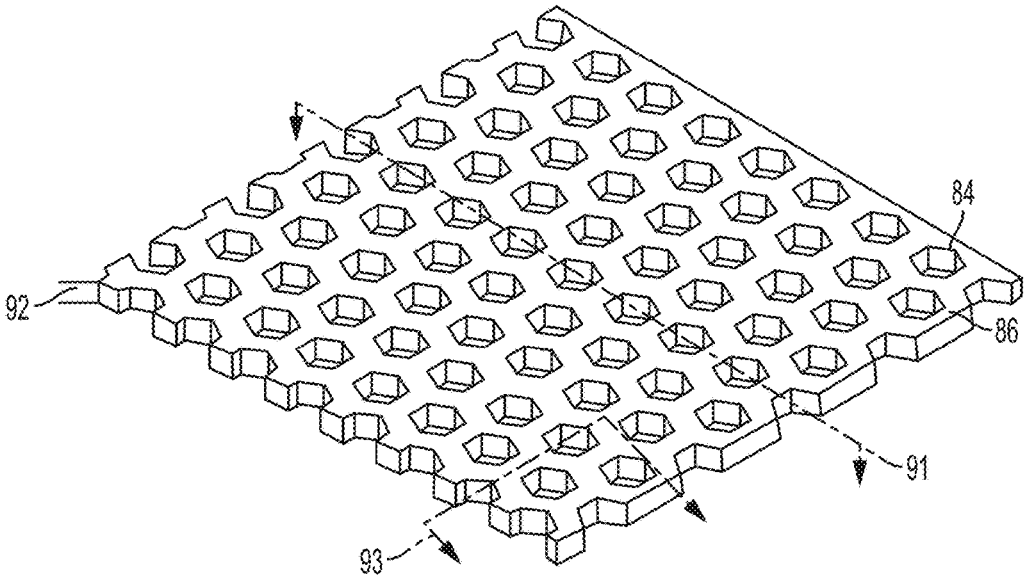
FIG. 8A is a perspective view of aspects of the invention.
Figure 8B:
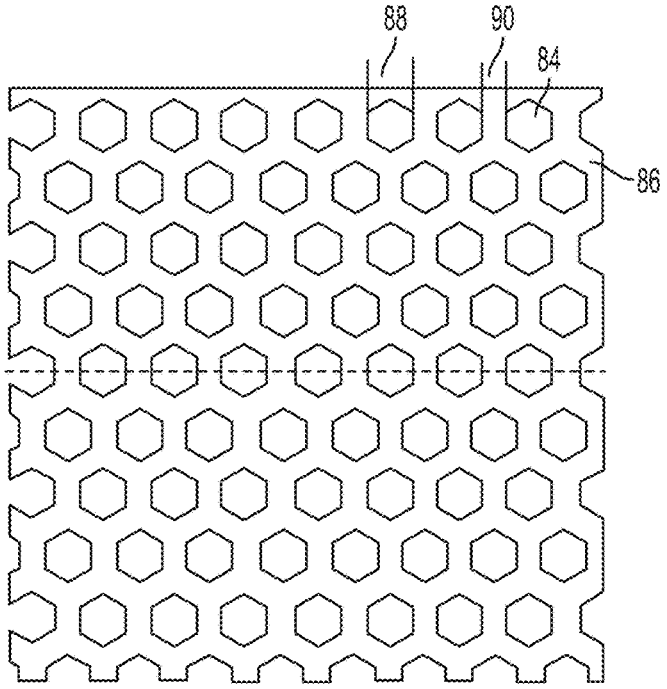
FIG. 8B is a top view of aspects of the invention.
Figure 9A:
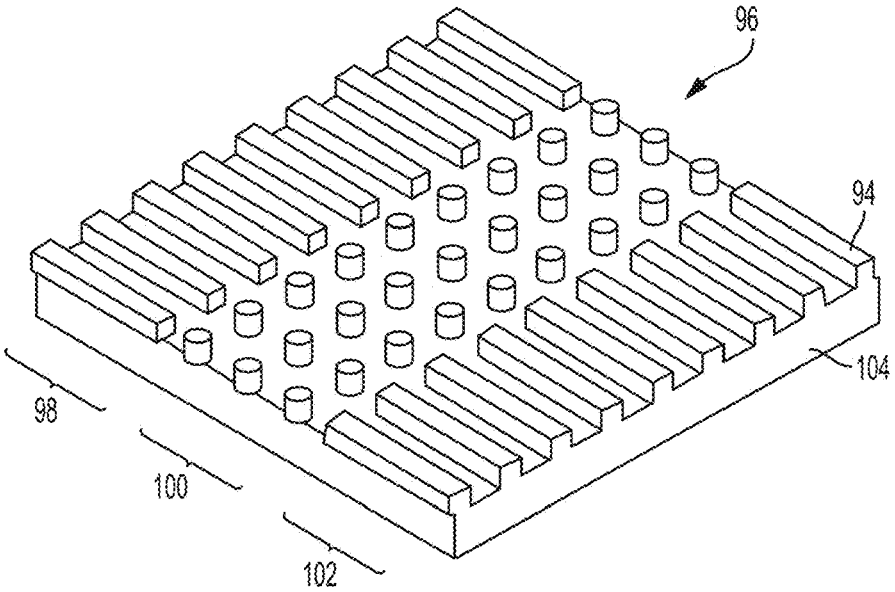
FIG. 9A is a perspective view of aspects of the invention.
Figure 9B:
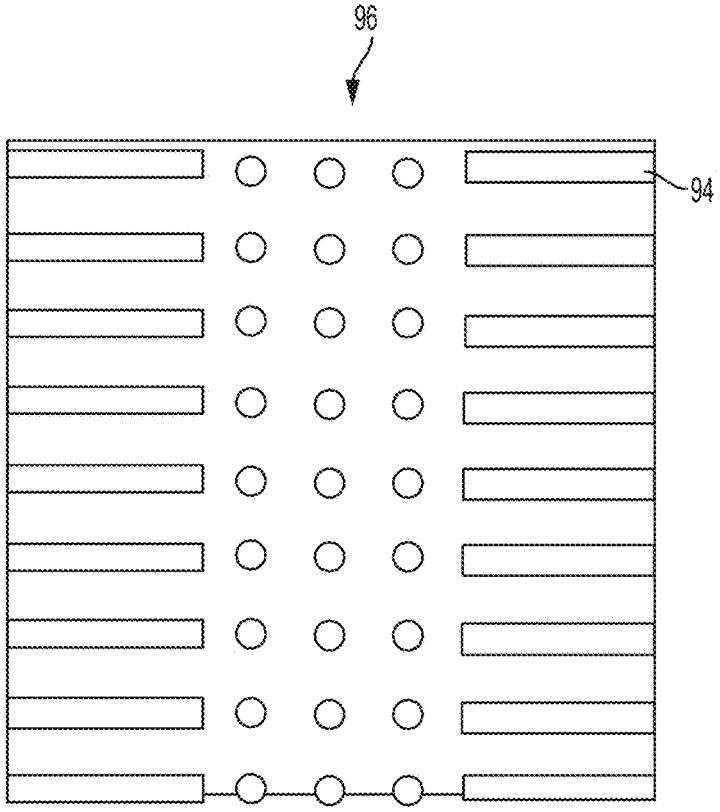
FIG. 9B is a top view of aspects of the invention.

Referring to FIGS. 8A and 8B, one embodiment is shown with opening 84 defined in a substrate 86. The opening can be circular, oval, polygon, asymmetrical shape or any combination thereof. In one embodiment, the opening is a hexagon. The opening can be separated as shown by 88 between 0.65 mm to 0.85 mm from side to side and the pitch 90 between sides can be in the range of 0.35 mm to 0.55 mm. The substrate can have a thickness 92 in the range of 0.35 mm to 0.50 mm. The elevated cross section along 91 can include concave portion defined in the substrate. The concave portion can be a partial circle, oval, or polygon. Referring to FIGS. 9A and 9B, the combination of these micro-features can be used to form a micro-structured surface. In this embodiment, ridges 94 are disposed adjacent to an arrangement of columns 96. The first set of micro-features 98 can be adjacent to a second set of micro-features 100 which can in turn be adjacent to a third set of micro-features 102. Two or more sets of micro-features can alternate along the substrate 104 to form a micro-structured surface.

Figure 10:
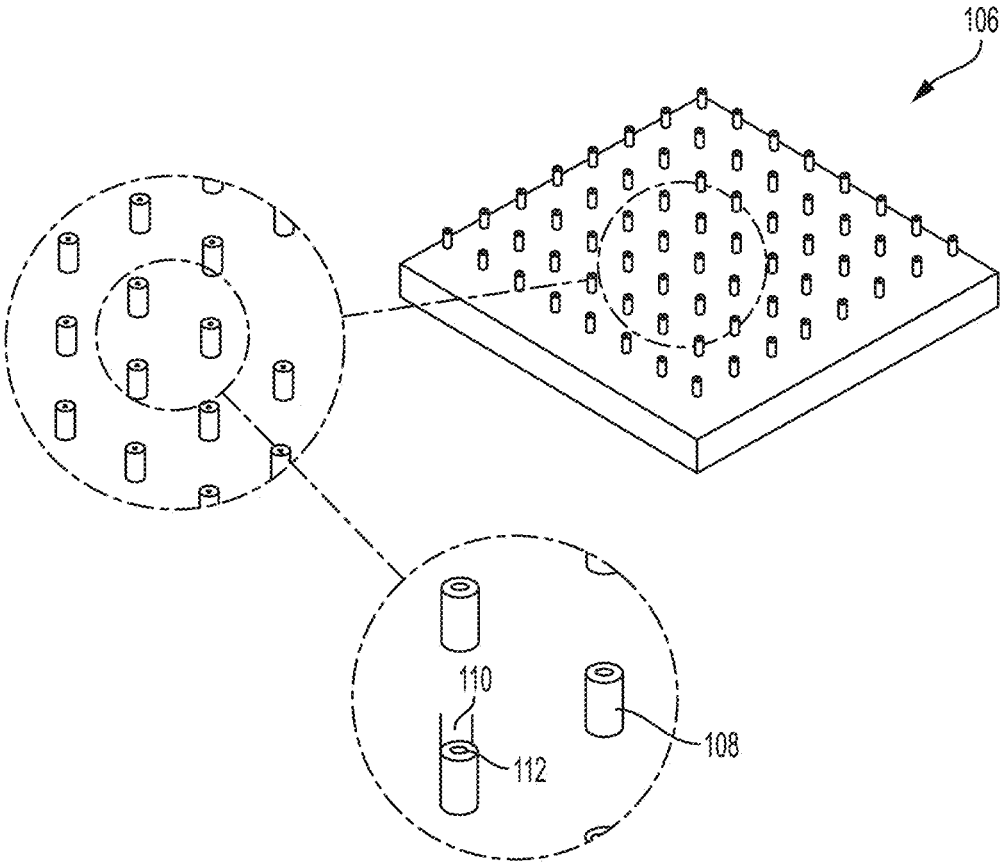
FIG. 10 is a perspective view of aspects of the invention.
Figure 11:
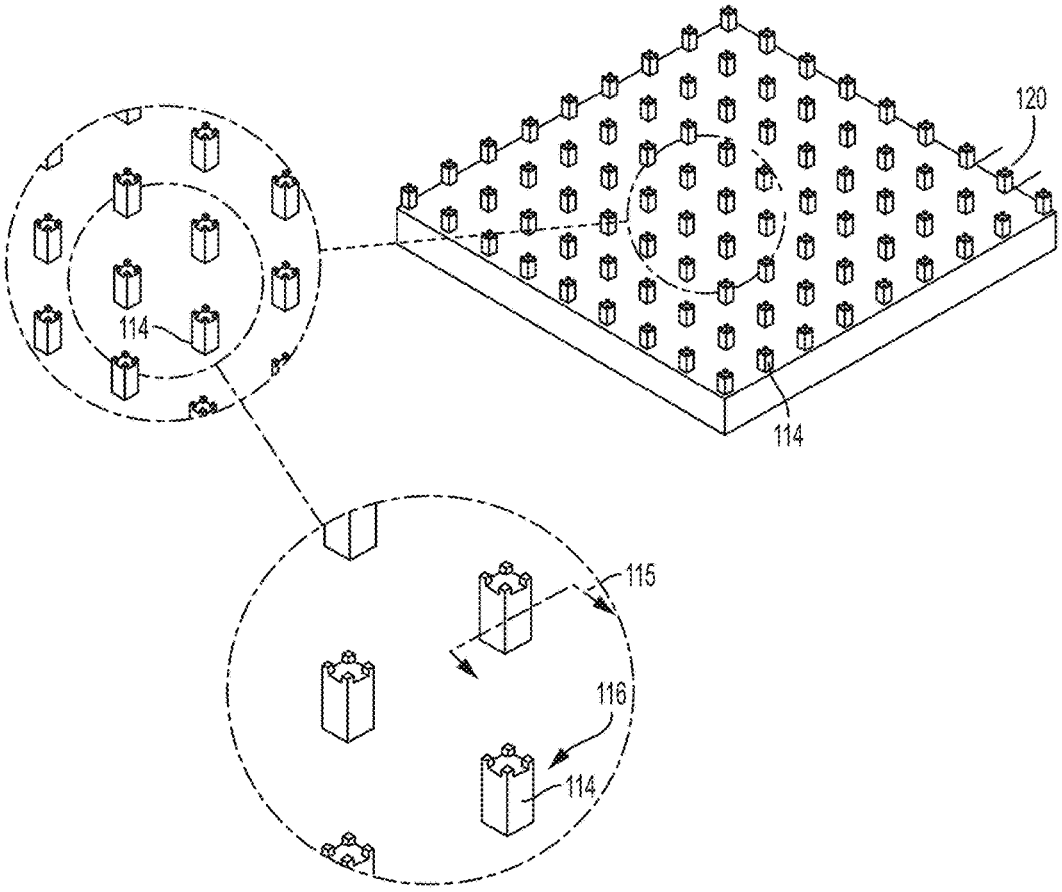
FIG. 11 is a perspective view of aspects of the invention.

Referring to FIG. 10, the micro-feature is shown that can be used to provide for improved insulation properties of a container. This aspect of the invention can be used to improve the tactical sensation of holding a hot container such as a cup and to eliminate the need for accessories such as cup sleeves. The micro-features can include a circular horizontal cross section and be generally column configuration. One or more columns of the micro-feature can include a vertical cavity defined in the column extended lengthwise along the column. The cavity can extend through the entire column or only through a portion of the column. The arrangement of columns 106 can include column 108 having an outer diameter 110 and an opening 112 defined in the top of the column. The opening can extend through the column and in one embodiment, extends into the column a depth in the range of 0.025 mm to the length of the column. The outer diameter can be in the range of 0.10 mm to 0.30 mm and the diameter of the opening can be in the range of 0.05 mm to 0.15 mm. Referring to FIG. 11, the micro-features 114 can have a horizontal cross section 115 that is a polygon and specifically a square in one embodiment. A second layer 116 of micro-features can be placed on the first micro-feature 114. In one embodiment, the second layer of micro-features includes secondary micro-feature 118 disposed at the corners of the top of the first micro-feature. In one embodiment, the first micro-feature has a width and length in the range of 0.10 mm to 0.30 mm and the secondary micro-feature has a width and depth in the range of 0.025 mm to 0.075 mm. The pitch 120 can be in the range of 1.10 mm to 1.30 mm.

The present invention can also reduce the amount of condensation on the outer wall of the beverage container when the beverage container contains a cold liquid. Different micro-feature patterns are placed on the outer wall; beverage containers were covered with thin sheets of polypropylene and embossed with the various micro-patterns. The beverage containers were then filled with a precise amount of ice and water. The exterior surface was dried and then the cups were placed in a 100% humid chamber on a dry dish. The humidity chamber was continuously replenished with humidity from a container of boiling water. The cups and the dish under the cup were weighed every 5 minutes for 25 minutes. The results of the weight of the condensation on the beverage container for each of the microstructure patterns is generally shown in Table 7.

TABLE 7

| Time | Control (2A) | #003AP (2B) | #0049AP (2D) | #008AP (2C) | #128AP (2E) | #129AP (2F) |
|---|---|---|---|---|---|---|
| 5 | 2.000 | 0.687 | 0.812 | 0.687 | 0.375 | 0.562 |
| 10 | 2.375 | 0.875 | 0.885 | 0.750 | 0.667 | 0.687 |
| 15 | 2.688 | 1.125 | 1.500 | 1.063 | 0.749 | 0.750 |
| 20 | 2.875 | 1.625 | 1.688 | 1.057 | 1.000 | 1.000 |
| 25 | 3.000 | 2.250 | 2.255 | 1.500 | 1.438 | 1.438 |

The weight in grams of the condensation in the dish placed under the beverage container is shown in Table 8 at various measurement times.

TABLE 8

| Time (s) | Control | #003AP | #008AP | #128AP | #129AP |
|---|---|---|---|---|---|
| 5 | 0.00 | 0.00 | 0.00 | 0.00 | 0.00 |
| 10 | 0.00 | 0.10 | 0.00 | 0.00 | 0.00 |
| 15 | 0.10 | 0.40 | 0.00 | 0.00 | 0.10 |
| 20 | 0.10 | 0.40 | 0.10 | 0.00 | 0.10 |
| 25 | 0.20 | 0.50 | 0.10 | 0.00 | 0.20 |

We also see that the height of the micro-features on the outer wall of the beverage container affects the amount of condensation produced. Generally, the higher the micro-feature height, the less condensation is produced. The relationship between the height of the micro-features and the condensation measured by weight is shown in Table 9.

TABLE 9

| Micro-feature Height (approximate μm) | Weight Condensation (grams) |
|---|---|
| 0 | 0.6 |
| 70 | 0.1 |

TABLE 9-continued

| Micro-feature Height (approximate μm) | Weight Condensation (grams) |
|---|---|
| 75 | 0.5 |
| 220 | 0.2 |
| 350 | 0.1 |
| 420 | 0.0 |

Initial finding show that pattern #128AP is the best performer in gathering the least amount of condensation on the cup. Additionally pattern #128AP was also the best performer in the amount of condensation that fell off the cup into a dish beneath it. The control pattern overall did the worst except for in one instance where #003AP did slightly worse in the amount of condensation gathered into a dish.

The weight of condensation on the dish below the cup for various micro-feature densities is shown in Table 10.

TABLE 10

| Micro-feature Density (percentage) | Weight Condensation (grams) |
|---|---|
| 5 | 0.2 |
| 10 | 0.0-0.5 |
| 20 | 0.1 |
| 25 | 0.1 |
| 100 | 0.6 |

The micro-patterns can be formed on paper, metal, ceramic, or plastic surfaces such as cups by embossing, stamping, injection molding, compression molding, laminating, ink jet printing, additive manufacturing processes, and by other ink printing processes. The ink printing processes can include techniques of using viscous inks that give raised features such as thermal transfer printing. Micro-features placed on the outer wall of a beverage container with heights between 70 μm and 1000 μm, and with micro-features densities of between about 0.5% and 25% reduce vapor condensation from a humid atmosphere.

In one scenario using an ambient test method, the test sample is a cup that is filled with ice water. The cup is placed on a pre-weighted dish. The cup and dish is placed in an ambient environment, such as an office setting or outdoors with humidity in excess 50%. After a pre-determined time, 1 hour in one scenario, the dish and cup is weighted and the difference from the prior weighting is recorded representing condensation.

In one embodiment a fog test method is used wherein a semi-sealed chamber with piezo humidifier generating fog equal to or greater than 90% humidity can be used. Boiling water placed in the chamber provides the humidity. In one embodiment, a fog generator is used including a chamber with a fan to circulate air to reduce or eliminate the humidity gradient. In one scenario, the lowering the fog generator output and potentially passing the fog through a mixing chamber to dissipate fog droplets into vapor results in around 75% relative humidity in the chamber. The results from these tests are shown in Table 11.

TABLE 11

| Pattern ID | Petri Dish wt. | Cup wt. | Added water and ice wt. | After 2 hrs cup + water and ice + petri dish wt. | After 2 hrs petri dish wt. | remaining condensation on dish |
|---|---|---|---|---|---|---|
| H216 | 8.31 | 22.07 | 430.69 | 454.12 | 8.41 | 0.1 |
| H217 | 8.31 | 23.66 | 407.55 | 441.07 | 8.39 | 0.08 |
| H218 | 8.31 | 23.32 | 418.99 | 443.83 | 8.4 | 0.09 |
| H219 | 8.3 | 21.62 | 413.15 | 444.45 | 8.38 | 0.08 |
| H220 | 8.31 | 21.01 | 408.23 | 430.03 | 8.37 | 0.06 |
| H221 | | | | | | 0 |
| H222 | 8.31 | 21.04 | 415.52 | 437.49 | 8.4 | 0.09 |
| H223 | 8.31 | 22.18 | 417.18 | 449.99 | 8.43 | 0.12 |
| H224 | 8.31 | 20.93 | 401.65 | 432.02 | 8.36 | 0.05 |
| H225 | 8.32 | 20.5 | 408.55 | 438.59 | 8.49 | 0.17 |
| H226 | 8.31 | 23.78 | 406.15 | 439.41 | 8.36 | 0.05 |
| H227 | 8.32 | 25.17 | 413.94 | 414.74 | 8.4 | 0.08 |
| H228 | 8.31 | 22.59 | 411.98 | 436.11 | 8.37 | 0.06 |
| H229 | 8.31 | 23.12 | 424.25 | 456.54 | 8.34 | 0.03 |
| H230 | 8.31 | 20.63 | 413.14 | 443.56 | 8.36 | 0.05 |
| H231 | | | | | | 0 |
| H232 | 8.31 | 24.36 | 404.65 | 431.04 | 8.36 | 0.05 |
| H233 | | | | | | 0 |
| H234 (H) | 8.31 | 20.29 | 428.1 | 449.83 | 8.34 | 0.03 |
| H235 | 8.31 | 21.66 | 415.43 | 446.93 | 8.35 | 0.04 |
| H236 | 8.31 | 23.73 | 410.64 | 435.87 | 8.36 | 0.05 |
| H237 | 8.33 | 21.6 | 409.95 | 441.01 | 8.33 | 0 |
| window screen | 8.32 | 16.65 | 403.11 | 429.32 | 8.55 | 0.23 |

Additional information is shown in Tables 12A and 12B.

TABLE 12A

| Pattern ID | Condensation Rate (grams) 2 of 3 smallest points | Adjusted size (size at top of feature) | Shape | pitch | depth | spacing | draft angle |
|---|---|---|---|---|---|---|---|
| H227AP | 0.00 | 450 | circle | 1200 | 2000 | 750 | 0 |
| H236AP | 0.00 | 450 | lines | 1200 | 420 | 750 | 0 |
| PP Mesh Screen | 0.00 | 460 | holes | 1280 | 340 | 820 | 0 |
| H226AP | 0.00 | 450 | circle | 1200 | 1000 | 750 | 0 |
| H232AP | 0.01 | 450 | lines | 1200 | 420 | 750 | 3 |
| H234AH | 0.01 | 450 | web of circles | 1200 | 420 | 1200 | 0 |
| H128AP | −0.01 | 450 | oval | 1200 | 420 | 750 | 0 |
| H218AP | 0.01 | 450 | circle | 750 | 420 | 300 | 0 |
| H233AH | 0.00 | 450 | web (honeycomb) | 1200 | 420 | 750 | 0 |
| H237AP | 0.04 | 381 | lines | 1200 | 420 | 819 | 14 |
| H235AP | 0.15 | 450 | lines + pillars | 1200 | 420 | 750 | 0 |
| H216AP | 0.08 | 450 | circle | 1200 | 420 | 750 | 0 |
| H230AP | 0.43 | 450 | oval with rounded top | 1200 | 420 | 750 | 30 |
| H229AP | 0.35 | 490.5 | oval | 1200 | 420 | 709.5 | 7 |
| H221AP | 0.42 | 100 | circle | 850 | 420 | 750 | 0 |
| H231AP | 0.40 | 450 | dimple | 1200 | 225 | 750 | 15 |
| H228AP | 0.59 | 490.5 | oval | 1200 | 420 | 709.5 | 15 |
| H219AP | 0.63 | 450 | circle | 1950 | 420 | 1500 | 0 |
| H217AP | 0.76 | 450 | circle | 500 | 420 | 50 | 0 |
| H222AP | 0.68 | 1000 | circle | 1750 | 420 | 750 | 45 |
| H220AP | 0.86 | 450 | circle | 3450 | 420 | 3000 | 0 |
| H224AP | 0.96 | 3000 | circle | 3750 | 420 | 750 | 45 |
| H225AP | 1.10 | 450 | circle | 1200 | 50 | 750 | 0 |
| H223AP | 0.98 | 2000 | circle | 2750 | 420 | 750 | 45 |
| Smooth Control | 1.03 | | | | | | |

TABLE 12B

| Pattern ID | Condensation Rate (grams) | Difference from Smooth Control | Percent Improvement |
|---|---|---|---|
| H227AP | 0.000 | 1.030 | 100.00% |
| H236AP | 0.000 | 1.030 | 100.00% |
| PP Mesh Screen | 0.000 | 1.030 | 100.00% |
| H226AP | 0.000 | 1.030 | 100.00% |
| H232AP | 0.010 | 1.020 | 99.03% |
| H234AH | 0.010 | 1.020 | 99.03% |
| H128AP | −0.010 | 1.040 | 100.97% |
| H218AP | 0.010 | 1.020 | 99.03% |
| H233AH | 0.000 | 1.030 | 100.00% |
| H237AP | 0.040 | 0.990 | 96.12% |
| H235AP | 0.150 | 0.880 | 85.44% |
| H216AP | 0.080 | 0.950 | 92.23% |
| H230AP | 0.430 | 0.600 | 58.25% |
| H229AP | 0.350 | 0.680 | 66.02% |
| H221AP | 0.420 | 0.610 | 59.22% |
| H231AP | 0.400 | 0.630 | 61.17% |
| H228AP | 0.590 | 0.440 | 42.72% |
| H219AP | 0.630 | 0.400 | 38.83% |
| H217AP | 0.760 | 0.270 | 26.21% |
| H222AP | 0.680 | 0.350 | 33.98% |
| H220AP | 0.860 | 0.170 | 16.50% |
| H224AP | 0.960 | 0.070 | 6.80% |
| H225AP | 1.100 | −0.070 | −6.80% |
| H223AP | 0.980 | 0.050 | 4.85% |
| Smooth Control | 1.030 | 0.000 | 0.00% |

In one embodiment, the oval is an ellipse. The adjusted size can define the size of the top of the micro-feature and can be in the range of 380 μm to 460 μm. In one embodiment, the adjusted size at the top can be in the range of 450 μm to 460 μm. Additional Information is shown in Table 13. Note that in table 13, distance measurements are provided in millimeter. For width measurements, oblong features are shown with two dimensions, width and length, while the remaining is shown with one measurement representing the width and length of the micro-feature.

TABLE 13

| Pattern | Shape | Width | Pitch | Spacing | Depth | Draft |
|---|---|---|---|---|---|---|
| H128A | Oval | 0.30 × 0.60 | 1.20 | 0.75 | 0.42 | 0 |
| H216A | Circle | 0.45 | 1.20 | 0.75 | 0.42 | 0 |
| H217A | Circle | 0.45 | 0.50 | 0.05 | 0.42 | 0 |
| H218A | Circle | 0.45 | 0.75 | 0.30 | 0.42 | 0 |
| H219A | Circle | 0.45 | 1.95 | 1.5 | 0.42 | 0 |
| H220A | Circle | 0.45 | 3.45 | 3.00 | 0.42 | 0 |
| H221A | Circle | 0.1 | 0.85 | 0.75 | 0.42 | 0 |
| H222A | Circle | 1.00 | 1.75 | 0.75 | 0.42 | 0 |
| H223A | Circle | 2.00 | 2.75 | 0.75 | 0.42 | 0 |
| H224A | Circle | 3.00 | 3.75 | 0.75 | 0.42 | 0 |
| H225A | Circle | 0.45 | 1.20 | 0.75 | 0.05 | 0 |
| H226A | Circle | 0.45 | 1.20 | 0.75 | 1.00 | 0 |
| H227A | Circle | 0.45 | 1.20 | 0.75 | 2.00 | 0 |
| H228A | Oval | 0.381 × 0.60 | 1.20 | 0.75 | 0.42 | 15° |
| H229A | Oval | 0.381 × 0.60 | 1.20 | 0.75 | 0.42 | 30° |
| H230A | Oval | 0.30 × 0.60 | 1.20 | 0.75 | 0.42 | 0 |
| H231A | Dimple | 0.45 | 1.20 | 0.75 | 0.225 | arced |
| H232A | Ridges | 0.45 | 1.20 | 0.75 | 0.42 | 3°. |
| H233A | Web | 0.45 | 1.20 | 0.75 | 0.42 | 0 |
| H234AH | Circle | 0.45 | 1.65 | 1.20 | 0.42 | 0 |
| H235A | Ridges and Pillars | 0.45 | 1.20 | 0.76 | 0.42 | 0 |
| H236A | Ridge | 0.45 | 1.20 | 0.75 | 0.42 | 0 |
| H237A | Ridges | 0.381 | 1.20 | 0.75 | 0.42 | 14°. |
| Polypropylene 20 × 20 mesh | | 0.46 | 1.26 | 0.83 | 0.34 | |

The anti-condensation properties of the present invention can be provided with specific micro-features and patterns. Any horizontal cross sectional geometric shape (circles, squares, triangles, holes or honeycomb, woven or punched mesh, ridges or any combination) can be used with spacing of 300 to 1200 microns; width 380 to 450 microns; depth 340 to 2000 microns; and optionally having sharp edges and with vertical sides of the micro features having draft angle less than 10 degrees. The micro-features can be added to a surface, substrate, product or tooling by molding, embossing, machining, extrusion, electrical discharge machining, laser engraving, contact printing, ink jet printing, 3D printing, rapid prototyping or other printing processes. The micro-features can be added to a surface adding a label, wrap, tape or sleeve made by molding, embossing, machining, extrusion, electrical discharge machining, or laser engraving. Surfaces having honeycomb and woven meshes can be used as auxiliary products such as sleeves, labels, tapes or wraps added to existing cold surfaces such as beverage containers, pipes, windows, and other embodiment wherein the physical properties of the present invention are advantageous. The through holes can improve visibility of liquid contents. Mesh and honey-comb products can be made by punching or piercing and stretching a sheet or made be made by weaving filaments to form a woven screen. The anti-condensation surface may be made of plastic, rubber, fiber, wood, metal, glass or ceramic. The anti-condensation micro-surface may be made of a different material than the cold surface.

It should be noted that multiple micro-features can be layers on a surface to provide for advantageous properties. For example, pillars on pillars or pillars on pillars on pillars.

In performing the tests to achieve the results described here and to describe the physical properties of the present invention, the objective is to determine a micro-feature pattern on a fiber hot cup that most effectively reduces surface contact points with a consumer's hand. By modifying the surface properties of the beverage container with micro-features, the consumer's comfort threshold is enhanced for holding beverage containers having a hot liquid and to provide a better grip. The beverage container can be single walled or double walled. This testing can include two phases, a motion oriented test and a thermal panel test. The motion oriented test aims measures the number of times the consumer must switch hands while walking across a predetermined distance and to also the timing at which it takes place. Additional consumer insight was gathered based off of questionnaires presented during each test. For the thermal panel test, consumers are given a cup set to compare and will be asked to fill out a questionnaire giving their temperature perception and ranking the hottest to coldest feeling cup.

The material used for the testing can include: hot plate (to insure the water stays the same temperature), coffee pot (to hold water inside between trials), water (kept at 190° F., tray (to transport cups to consumer), thermometer (measure the temperature of the water), stopwatch (timing how long people hold cup), cup samples, control cups, lids, sleeves, cup of room temperature (neutral temperature surface for use before each cup sample is tested), questionnaires, and walking space. The preparation for testing includes the steps of: preparing samples in packaging lab, labeling cups corresponding to different variables, marking fill level on all cups, validating how long it takes to fill, cap, and hand cup to consumer, providing pretest questionnaire to consumer via email after sign up, preforming a motion oriented test, recording which cup the consumer is testing before the motion test, preforming a thermal panel test, marking tray with corresponding letters to the sample ID's of each cup trial to match cups with questionnaires.

In performing a motion oriented test, pre-preparation steps are performed as stated herein. The temp of the water is measured to insure it is at the proper temperature, such as 190° F. in one test scenario. The sample to be tested is filled with the heated water to a predetermined level, between 60% and 95% full in one embodiment. The sample is placed on a tray. Test subjects are interviewed to inquire how they would hold the test sample, a cup on one test scenario and with which hand. The test subjects grip style on cup is observed and photographed. The test subject holds a neutral temperature cup, room temperature in one scenario, before handling test sample. The test sample is handled by the test subject. The test subject is requested to walk from a starting point, along a path, wherein the path represents normal walking pattern in one embodiment, while holding the test sample. The test subject is observed how many times the test subject changes hands, grip styles, or releases the test sample altogether. These events are recorded with associated timestamps. In one embodiment, the time stamps are determined from a video recording these events. Once the path is completed, the test subject is provided with a control sample with a sleeve and requested to repeat the path. In one embodiment, the path is reversed with the control sample. The test subject is provided with a questionnaire concerning the test sample and the control samples. The samples are collected form the set subjects at the conclusion of test.

When conducting the thermal panel test, the pre-test preparations are performed as stated herein. The temperature of the water is measured to insure that it is about 190° F. in one scenario. In one scenario, three test samples are selected to be provided to test subjects. The test samples are placed on a tray in predetermined positions (e.g. A, B, and C position). The test subjects were interview as to how they would hold the test sample and with which hand. The test sample is then filled with heated water and capped. Prior to allowing the test subject to handle the test sample, the test subject is provided with a neutral temperature sample prior to handling the test sample with heated water. The test subject is then instructed to handle the test sample until it is no longer comfortable to do so. The time is observed and recorded and once the test subject releases the first test samples, the process is released for additional test samples (e.g. A, B, and C). The test subject then ranks the test samples from hottest to coldest. In one scenario, the test subjects rank 1 to 3 with 1 being no difference and 3 being a large difference in temperature between the test samples. The hold time for each test subject for each test samples can also be recorded, correlated with the ranking and used to provide some validation of the ranking. The test subjects can then be interviewed concerning any additional comments directed to the grip or other measureable attributes from a questionnaire.

The testing for determining the physical properties of the concerning condensation were performed using the following materials: hot plate (heat water to create humidity chamber), coffee pot (hold water during heating), water (water will be kept at 190° F. or above), tray (transport cups), thermometer, stopwatch, lids for cups, beaker, and scale.

The following procedures can be followed to perform the thermal panel test that can include the following steps. First, a heating source such as a hot plate can be activated and heat a liquid such as water in a first container. The temperature of the heated liquid is measured periodically and recorded. A second container is used with dishes that can be placed around the container. Each dish can be assigned to the test sample and the initial weight of each dish with the test sample and optionally a lid is taken and recorded. The test samples can be filled with ice and a liquid such as water. In one embodiment, the test samples are filled with between 150 and 225 grams of ice and 100 to 300 grams of water. Lids can be placed on the test samples. When the water in the first container reaches or exceed about 180° F., in one scenario, the test samples are placed on the respective dishes. The heated liquid is place on the second container and a covering is placed over the second container and the test samples to create a humidity chamber. The time is recorded and once a pre-determined period of time has elapsed, the cover is removed. The weights of each test samples, each dish, and the final temperature of each cup. The difference in the weight of the cup initially and after the above process represents the amount of condensation.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A micro-featured surface with improved insulation and condensation resistance comprising:

a substrate;

a micro-structure included with the substrate having an arrangement of a first set of micro-features and a second set of micro-features;

a first micro-feature horizontal cross section taken from the group consisting of a circle, oval, polygon, and concave portion;

a first micro-feature horizontal cross section dimension included in the first set of micro-features in a range of 300 μm to 750 μm;

a pitch included in the micro-structure in a range of 450 μm to 1650 μm;

a spacing between the first set of micro-features in the micro-structure in the range of 300 μm to 1650 μm;

a depth of the first set of micro-features in a range of 420 μm to 2000 μm;

a condensation rate less than 0.15 grams when measure by an ambient test method;

a second set of micro-features included in the first set of micro-features having a second micro-feature horizontal cross section taken from the group consisting of pillars and opening;

a second micro-feature horizontal cross section dimension included in the second set of micro-features equal to or less than and the horizontal cross section dimension of the first micro-feature and, an improved hold time of 23.00% or greater when hold tested wherein a micro-feature density is in a range of 0.5% to 25.00%.

2. The surface of claim 1 wherein the substrate is a beverage container.

3. The surface of claim 1 wherein the second set of micro-features includes an opening defined in a top of a first micro-feature having a diameter of less than the horizontal cross section dimension of the first micro-feature and extending into a micro-feature at least 50% of the total height of the first and second micro-feature combined.

4. The surface of claim 1 wherein the second set of microfeatures includes a pillar extending upward from a top of a first micro-feature having a width of about 50 μm and a height of about 50 μm.

5. The surface of claim 1 wherein a width of a micro-feature in the first set of micro-features has a length greater than a width and are arranged offset relative to an adjacent first micro-feature in the micro-structure.

6. The surface of claim 5 wherein the micro-features are arranged in an alternating orthogonal pattern in the micro-structure.

7. The surface of claim 1 including a generally flat top in each first micro-feature.

8. A micro-featured surface with improved condensation resistance comprising:

a micro-structure having a substrate and having an arrangement of micro-features;

a micro-feature horizontal cross section taken from the group consisting of a circle, oval, polygon, and concave portion;

a micro-feature cross section dimension included in each micro-feature in the range of 300 μm to 750 μm;

a pitch included in the micro-structure in the range of 450 μm to 1950 μm;

a spacing between the micro-features in a range of 50 μm to 1650 μm;

a depth of the micro-features in a range of 230 μm to 2000 μm; and, a condensation rate improvement greater than 25%.

9. The surface of claim 8 wherein the micro-features are arranged in an alternating orthogonal pattern in the micro-structure.

10. The surface of claim 8 including curved sides on at least one micro-feature.

11. The surface of claim 8 wherein the condensation rate is less than 0.75 grams when measure by the ambient test method.

12. The surface of claim 8 including a conical section included in at least one micro-feature having a top angle in a range of 130° to 150°.

13. The surface of claim 12 including a lower section disposed between the substrate and the conical section wherein the lower section has elevated cross section of a rectangle.

14. The surface of claim 8 including an elevated cross section included in the micro-feature having a polygon elevated cross section an opening angle in the range of 10° to 50°.

15. The surface of claim 8 wherein the micro-features are ridges defining channels dispose between the ridges wherein the ridges have a width in the range of 300 μm to 500 μm.

16. The surface of claim 15 wherein the ridges include tapered side with an open angle in the range of 2° to 5°.

17. The surface of claim 8 including openings defined in the substrate having a horizontal cross section taken from the group consisting of a circle, oval, polygon and any combination thereof.

18. The surface of claim 8 wherein the substrate includes an attachment side to attach the substrate to an article so that a micro-structured side is facing outward from the article.

19. A micro-featured surface with improved insulation and condensation resistance comprising:

a micro-structure disposed on a substrate having a first set of micro-features included on the substrate and a second set of micro-features included in the first set of micro-features;

a first micro-feature horizontal cross section taken from the group consisting of a circle, oval, polygon, and concave portion;

a first micro-feature horizontal cross section having a width of about 200 μm;

a second micro-feature horizontal cross section taken from the group consisting of pillars and opening;

a second micro-feature horizontal cross section dimension included in the second set of micro-features equal to or less than the horizontal cross section dimension of the first micro-feature; and, an improved hold time of 23.00% or greater when hold tested wherein a micro-feature density is in the range of 0.5% to 25.00%.

20. The surface of claim 19 wherein a spacing is about 120 μm and a height of the first micro-feature is in a range of 350 μm and 2000 μm.

21. The surface of claim 19 wherein first micro-feature has a diameter of about 200 μm and the second micro-feature has a diameter of about 100 μm or less.

* * * * *